United States Patent [19]

Lustig

[11] Patent Number: 4,873,935

[45] Date of Patent: Oct. 17, 1989

[54] COMBINED CANOE SEAT AND PORTAGE YOKE

[76] Inventor: Robert S. Lustig, Rte. 3, Box 194, Berkeley Springs, W. Va. 25411

[21] Appl. No.: 93,238

[22] Filed: Sep. 4, 1987

[51] Int. Cl.[4] ..... B36B 17/00

[52] U.S. Cl. ..... 114/347; 114/363

[58] Field of Search ..... 114/343, 347, 363, 364, 114/65 R; 441/43, 130, 129; 297/1, 3, 195, 201

[56] References Cited

U.S. PATENT DOCUMENTS

| | | | |
|---|---|---|---|
| 609,956 | 9/1898 | Brosnihan | 114/363 |
| 1,026,898 | 5/1912 | Benson | 114/363 |
| 2,815,517 | 12/1957 | Andresen | 114/363 |
| 3,718,365 | 2/1973 | Gibson | 114/363 |
| 3,958,289 | 5/1976 | Carlson | 114/363 |
| 4,016,615 | 4/1977 | Main | 114/343 |
| 4,236,267 | 12/1980 | Lewis | 114/347 |
| 4,357,894 | 11/1982 | Kirk | 114/363 |
| 4,380,208 | 4/1983 | Goserup | 114/347 |
| 4,567,845 | 2/1986 | Smith | 114/363 |

*Primary Examiner*—Joseph F. Peters, Jr.
*Assistant Examiner*—Clifford T. Bartz

[57] ABSTRACT

The present invention is a combined canoe seat and portage yoke which comprises fore and aft support members adapted to extend across the width of the canoe, first and second saddle yoke portions each having means for engaging said fore and aft support members in respective first positions defining a seat position wherein said first and second saddle yoke portions are substantially contiguous with each other, and in respective second positions defining a portage yoke position wherein said first and second saddle yoke portions are spaced apart from each other.

15 Claims, 3 Drawing Sheets

COMBINED CANOE SEAT AND PORTAGE YOKE

FIELD OF THE INVENTION

This invention relates generally to canoes and more particularly relates to a combined seat and portage yoke for canoes.

BACKGROUND OF THE INVENTION

In solo canoeing a paddler is typically seated at or near the longitudinal center of the canoe. Often in the course of canoeing, it becomes necessary to lift and carry the canoe around excessively turbulent water, over stretches of land, etc. This has resulted in some difficulty in that, when heretofore known seats are located in the center of a canoe, carrying the canoe by a solo user becomes difficult because such seats obstruct the central position in which the head and shoulders of the user must be located for portage.

Another problem encountered with some known seats is that the feet of the user may become entrapped under the seat if the canoe tips. This is an unsafe condition which should be avoided.

DESCRIPTION OF THE PRIOR ART

U.S. Pat. No. 4,503,799 discloses a combination floatation, storage, and seating structure for boats. The structure of U.S. Pat. No. 4,503,799 is a molded, contoured seat saddle. The body has hatch covers which allow access to the interior thereof for storage and the like. This structure can not be used as a portage yoke. In fact, its position and bulk makes carrying the canoe difficult for a solo user.

U.S. Pat. No. 4,357,894 is directed to a canoe seat construction for achieving optimum weight distribution. The seat is carried by a seat frame for movement longitudinally on the canoe. This structure is not suited for use as a portage yoke.

U.S. Pat. No. 4,016,615 discloses a canoe portage kit which contains two identical spring-loaded telescopic rods which are attached parallel to each other to and between the central bar of the canoe and any other strut on either side of the central bar. This structure is not suitable for use as a seat.

U.S. Pat. No. 2,671,231, discloses a canoe yoke of a flexible, web-like construction which will provide a cushioning carrying pad for the shoulders of a person to support the weight of the canoe thereon. This patent does not disclose the use of the canoe yoke for a seat.

None of the prior art canoe seats or portage yokes discussed above comprise an adjustable canoe seat which quickly and easily rearranges to form a portage yoke-type support for comfortably carrying the canoe.

SUMMARY OF THE INVENTION

Accordingly, it is an object of this invention to provide a combined canoe seat and portage yoke which can quickly and easily be rearranged from a seating position to a portage yoke carrying position. Another object is to provide a combined canoe seat and portage yoke which allows the paddler to be positioned for optimum weight distribution and maximum effectiveness in handling the canoe while in the seating position, and which can be adjusted to obtain optimum carrying balance while in the portage yoke position.

Another object of the invention is to provide a combined canoe seat and portage yoke wherein the height of the seat within the boat can be adjusted to achieve optimum balance and stability and an optimally comfortable kneeling or seating position. As is well known, a lower kneeling or seating position results in a lower center of gravity which in turn provides for greater stability. On the other hand, a higher kneeling or seating position may result in more comfort for some users. The combined canoe seat and portage yoke allows the user to obtain a seating height to suit his particular needs at any particular time.

These and other objects of the invention are attained by a combined seat and portage yoke which can be easily mounted to the gunwales of a canoe. The combined canoe seat and portage yoke of the present invention comprises fore and aft support members or thwarts adapted to extend across the width of the canoe. The support members have a plurality of mounting positions for mounting first and second saddle yoke portions each having fore and aft arm members which are adapted to engage the fore and aft support members. The combined canoe seat and portage yoke has a first position defining a seat position wherein said first and second saddle yoke portions are substantially contiguous with each other, and a second position defining a portage yoke position wherein said first and second saddle yoke portions are spaced apart from each other. The fore and aft support members extend in parallel across the width of the canoe and are fastened on, i.e., the gunwales of a canoe. The first and second saddle yoke portions extend substantially in parallel along the longitudinal axis of the canoe.

BRIEF DESCRIPTION OF THE DRAWINGS

The objects, features and advantages of the present invention will be more readily appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
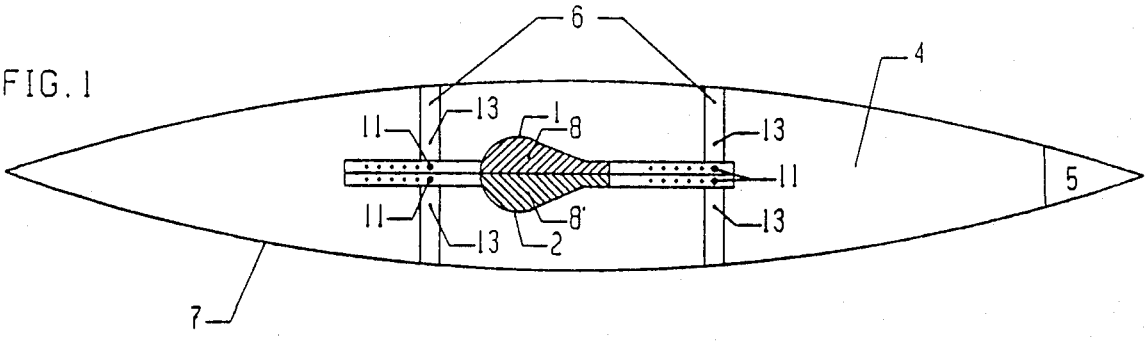
FIG. 1 is a plan view showing an embodiment of the adjustable combined canoe seat and portage yoke in accordance with the invention installed in a standard canoe and arranged in the seat position.
Figure 2:
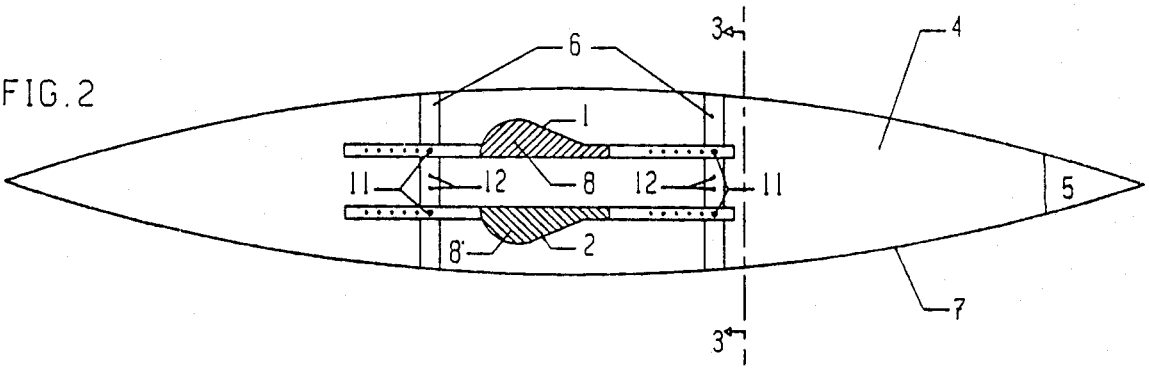
FIG. 2 is a plan view showing an embodiment of the adjustable combined canoe seat and portage yoke of FIG. 1 arranged in the portage yoke position.

FIG. 1 and FIG. 2 show an embodiment of the adjustable combined canoe seat and portage yoke installed in a standard canoe 4. The invention consists of four main parts, the first and second saddle yoke portions 1, 2, and a pair of identical fore and aft support members or thwarts 6. These members may be constructed of any material having sufficient strength and water resistance including but not limited to laminated or solid wood, plastic and metal. The thwarts 6 are attached to the gunwales or sides 7 of the canoe 4 by any securing means such as wood screws, nuts and bolts, clamps, rivets or other connections. Such connections may be substantially permanent or made in a manner so that the thwarts are easily released from the gunwales.

Figure 4:
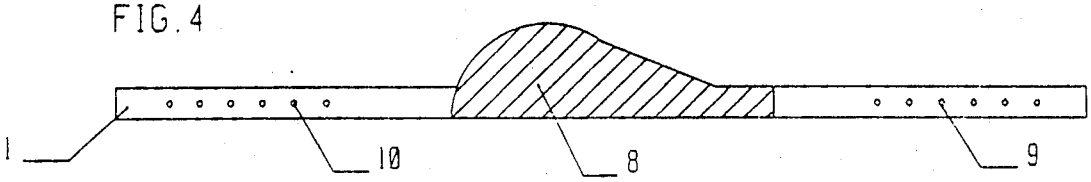
FIG. 4 is a plan view showing in greater detail one embodiment of a saddle yoke portion according to the invention.

Referring now to FIGS. 1, 2, 4, and 5, the distance separating the fore and aft support members or thwarts 6 must be such as to align with pairs of fore and aft indexing apertures 9, 10 located on the fore and aft arms of the saddle yoke portions as shown on FIG. 4. As long as such registry occurs, the distance separating the fore and aft support members 6 may be positioned according to the discretion of the user.

Figure 5:
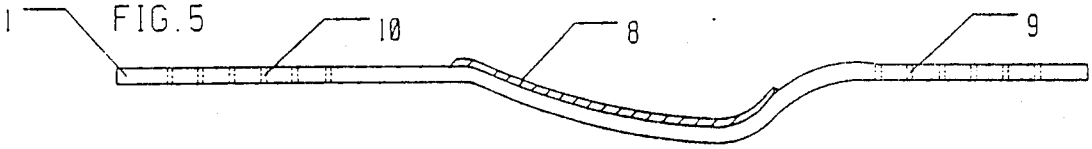
FIG. 5 is a side elevation of the saddle yoke portion of FIG. 4.

FIG. 4 and 5 illustrate one embodiment of the first saddle yoke portion 1. The second saddle yoke portion 2 can be, but is not limited to, a mirror image of the first saddle yoke portion. Any number of indexing apertures 9, 10 extending through the fore and aft arms of the saddle yoke portions can be provided. The embodiment illustrated has six fore and six aft indexing apertures. The saddle yoke portions are preferably equipped with padding cushions 8.

Figure 3:
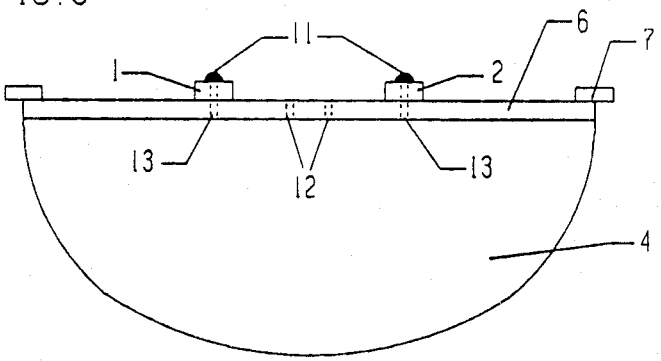
FIG. 3 is an enlarged sectional view of line 3—3 of FIG. 2.

In the embodiment of FIGS. 1 to 3, the saddle yoke portions 1 and 2 are attached to the support members 6 by means of four threaded devices 11 passing through appropriate pairs of fore and aft indexing apertures 9, 10 in the saddle yoke portions 1, 2 and engaging sets of threaded holes 12 or 13 in support members 6. When the saddle yoke portions 1, 2 are engaged in the inner threaded holes 12, the combined canoe seat and portage yoke is in the seating position as shown in FIG. 1. In this position the padded portions 8,8' of saddle yoke portions 1, 2 respectively, are substantially contiguous with each other forming a comfortable seat. When the saddle yoke portions 1 and 2 are engaged in the outer thread holes 13 the combined canoe seat and portage yoke is in the carrying yoke position as shown in FIGS. 2 and 3. In this position, the canoe may be inverted and the padded portions engaged with the shoulders of the user. In this manner the canoe may be comfortably carried on the shoulders with the head of the user in the space between padded portions 8,8'. The user can also grip the fore arms of saddle yoke portions 1,2 in the carrying position to steady the canoe on the shoulders.

The indexing apertures are selectively engaged with supports 6 in the seating position to move the seat fore and aft in the canoe as desired. In this manner the position of the paddler is adjusted for best balance in the canoe.

In the carrying position the saddle yoke portions can likewise be adjusted longitudinally of the canoe by engaging selected indexing apertures 9,10 with supports 6. In this manner, padded portions may be positioned for best balance in the carrying position. Further, the contour of padded portions 8,8' permit the shoulders to be easily shifted slightly within the area defined by portions 8,8' to further adjust the carrying position for virtually perfect balance.

Figure 6:
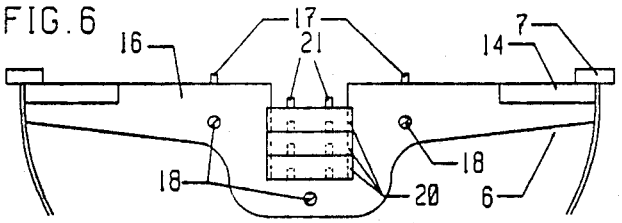
FIG. 6 is a front elevation of an alternative embodiment of a support member comprising means for seat height adjustment in the seat position.

FIG. 6 shows another embodiment of a support member according to the present invention which allows for seat height adjustment. The support member is made of two substantially horizontal members 14 which are attached to the gunwales or sides of the canoe 7 with suitable fasteners. A vertical member 16 is permanently attached by any suitable means such as rivets, nuts and bolts, etc., to the horizontal members 14. The vertical member 16 has two indexing pins 17 for engaging apertures 9,10 in the saddle yoke portions when in the portage yoke position as previously described. Any of the series of holes 9,10 in the arms extending fore and aft of the saddle yoke portions 23 can be used for balance adjustment of the yoke as previously described.

Figure 8:
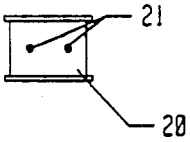
FIG. 8 is an enlarged plan view of the height adjustment means of the support member of FIGS. 6–7.
Figure 9:
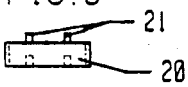
FIG. 9 is an enlarged front elevation of the height adjustment means of FIG. 8.

In another aspect of the embodiment of FIG. 6, the center of the vertical member 16 is adapted to receive seat height adjusting shims 20 which have indexing pins 21 for engaging the indexing holes in the saddle yoke portions in the seating position. Detail of shims 20 is illustrated in FIGS. 8–9. The seat can be raised or lowered by the addition of or removal of shims 20. The fore-aft pitch of the seat can be varied by using different numbers of shims 20 in the fore and aft supports, respectively.

Figure 10:
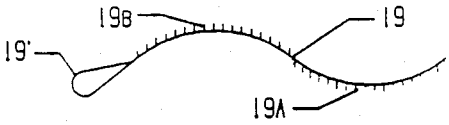
FIG. 10 illustrates a securing means for the saddle yoke portions.
Figure 11:
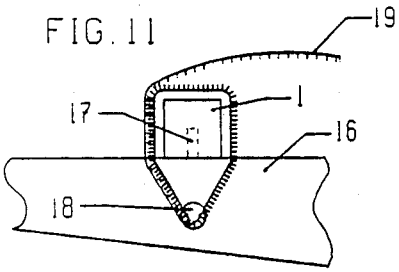
FIG. 11 is a front elevation of a saddle yoke portion fastened with a securing means as illustrated in FIG. 10.

FIGS. 6–7 and 10–11 illustrate means for securing saddle yoke portions 1,2 in the seat and/or portage yoke position. This includes an element, such as pin 18, secured to support 6, adjacent each pin 17 and adjacent shims 21. Securing means, such as strap 19, illustrated in FIG. 10, is adapted to be retained on pin 18 such as by loop 19'. In the embodiment illustrated, strap 19 comprises a loop and pile fastener, such as that sold under the VELCRO trademark, including loops 19*a* and pile 19*b*. Strap 19 may be wrapped about the fore or aft arm of the saddle yoke portion resting on the support, as shown in FIG. 11, whereby the loops 19*a* engage pile 19*b*, thus securing the saddle yoke portion in position.

This form of fastener is especially convenient and may be readily released and refastened. Pin 18 may be replaced by, for example, a hook or other suitable member. Strap 19 may be replaced by e.g., an elastic cord or a strap with an adjustable buckle.

Figure 7:
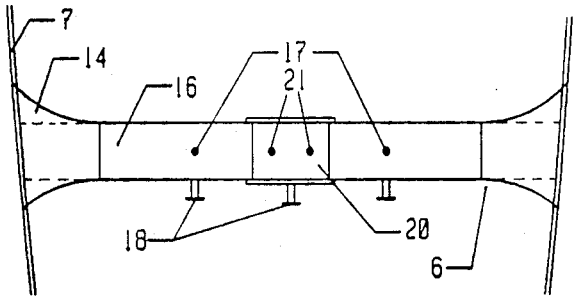
FIG. 7 is a plan view of the support member of FIG. 6.
Figure 12:
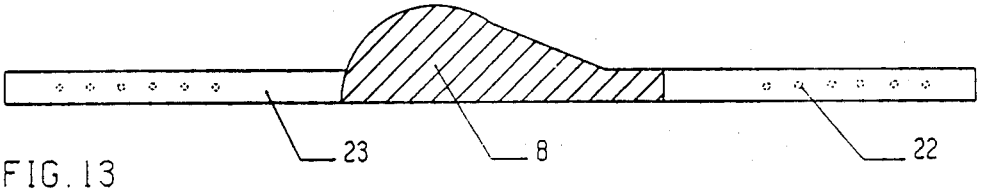
FIG. 12 is a plan view of an alternate embodiment of a saddle yoke portion.
Figure 13:
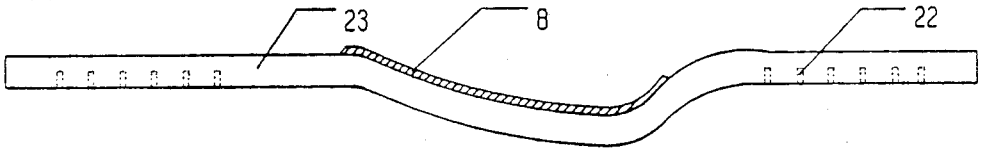
FIG. 13 is a side elevation of the saddle yoke portion of FIG. 12.
Figure 14:
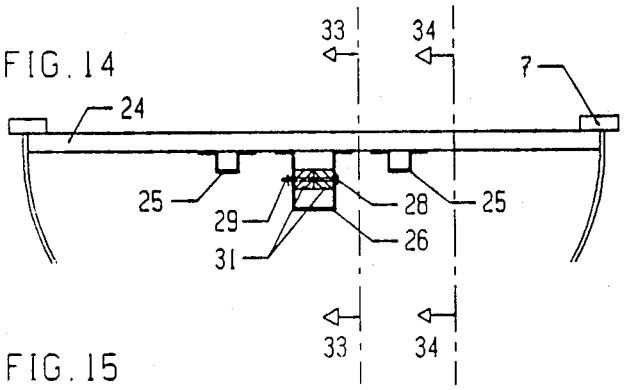
FIG. 14 is a front elevation of another embodiment of a support member which allows seat height adjustment.
Figure 15:
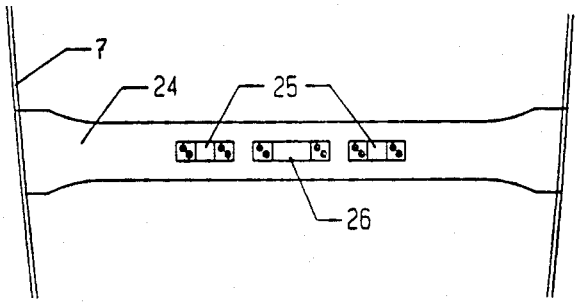
FIG. 15 is a view from below of the support member of FIG. 14.
Figure 16:
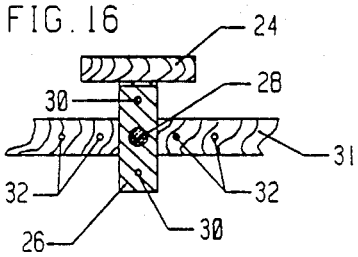
FIG. 16 is a sectional view of a support member along line 33—33 of FIG. 14.
Figure 17:
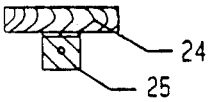
FIG. 17 is a sectional view along line 34—34 of FIG. 14.

FIGS. 12–13 illustrate an alternate embodiment 23 of a saddle yoke portion which may be used with the supports 6 of FIGS. 6–7. This includes apertures 22 formed partially through the fore and/or aft arms of the saddle yoke portion for engaging pins 17 or pins 21. Alternately, the saddle yoke portions of FIGS. 1–4, including through holes 9–10 may be employed with the supports of FIGS. 6–7.

Figure 18:
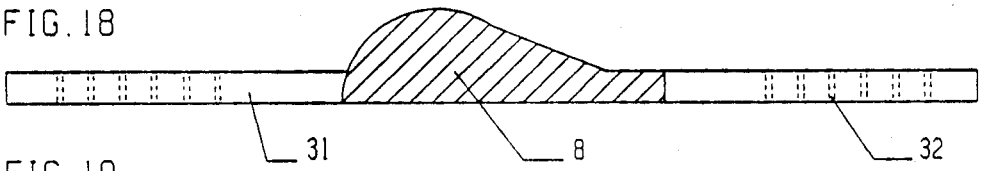
FIG. 18 is a plan view of yet another embodiment of a saddle yoke portion.
Figure 19:
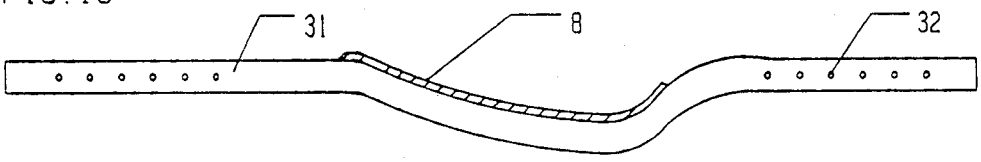
FIG. 19 is a side elevation of the saddle yoke portion of FIG. 18.

FIG. 14 through FIG. 19 show another embodiment of the present invention including a support member 24 which also provides for seat height adjustment. The support member 24 is attached to the gunwales or sides 7 of the canoe in any suitable manner as discussed above. The fore and aft support members 24 are each provided with two brackets 25 to hold the saddle yoke portions 31, designated in FIGS. 14–19, in the portage yoke position and a bracket 26 for the seating position. A pin 28 with a locking clip 29 can be inserted through the brackets 25 and 26 and engage various horizontally disposed indexing apertures 32 in the saddle yoke portions 31, as best seen in FIGS. 18–19. A single aperture is formed in each side of each bracket 25 for securing saddle yoke portions in the portage yoke position. A plurality of vertically spaced sets of apertures are formed in brackets 26 to provide optimum height adjustment in the seating position. Thus, the pin 28 may be inserted through various holes 30 in the seating bracket 26 to provide up and down adjustment of the seat. The fore-aft pitch of the seat can be varied by using different sets of holes 30 in the fore and aft seat brackets 26, respectively.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A combined canoe seat and portage yoke which comprises:

fore and aft support members transversely extended across the width of the canoe and spaced longitudinally apart along the length of the canoe, first and second saddle yoke portions each having means for engaging said fore and aft support members, said fore and aft support members comprising first mounting means for locating said saddle yoke portions in respective first positions defining a seat configuration wherein said saddle yoke portions are:

generally horizontal, longitudinally extended, disposed at a level above the bottom of the canoe, and spaced substantially contiguous with each other; whereby a paddler may straddle said saddle yoke portions and utilize the combined breadth of said portions to comfortably support the buttocks while sitting or kneeling in the canoe, said fore and aft support members comprising second mounting means for locating said saddle yoke portions in respective second positions defining a portage yoke configuration wherein said saddle yoke portions are: generally horizontal, longitudinally extended, disposed at a level above the bottom of the canoe, and spaced laterally apart from each other on generally opposite sides of the canoe; whereby said saddle yoke portions will define two support surfaces for engagement by the shoulders of a carrier when the canoe is inverted for transport.

2. A combined canoe seat and portage yoke according to claim 1, wherein said first mounting means each comprise adjustable means for varying the height of said saddle yoke portions in said first positions.

3. A combined canoe seat and portage yoke according to claim 1, wherein said mounting means for locating said saddle yoke portions in said first and second positions comprises brackets on said support members.

4. A combined canoe seat and portage yoke according to claim 2, wherein said adjustable means comprises shims adapted to be inserted between the upper surfaces of said fore and aft support members and the lower surfaces of said saddle yoke portions.

5. A combined canoe seat and portage yoke according to claim 2 wherein said adjustable means comprises a vertically elongated bracket and securing means for engaging said first and second saddle yoke portions with said bracket at a plurality of positions at varying heights.

6. A combined canoe seat and portage yoke according to claim 1, further comprising indexing means for adjustably positioning said saddle yoke portions on said fore and aft support members longitudinally along the length of the canoe.

7. A combined canoe seat and portage yoke according to claim 6, wherein said indexing means comprises apertures spaced along said saddle yoke portions.

8. A combined canoe seat and portage yoke according to claim 1, wherein said saddle yoke portions are mirror images of each other.

9. A combined canoe seat and portage yoke according to claim 1, comprising means for securing said saddle yoke portions to said support members.

10. A combined canoe seat and portage yoke according to claim 9, wherein said securing means comprises threaded members.

11. A combined canoe seat and portage yoke according to claim 9, wherein said securing means comprises straps secured to said support members.

12. A combined canoe seat and portage yoke according to claim 1, wherein each said saddle yoke portion comprises a padded seat portion.

13. A combined canoe seat and portage yoke according to claim 1, wherein said mounting means for locating said saddle yoke portions in said first and second positions comprises pins on said support members.

14. A combined canoe seat and portage yoke according to claim 1, wherein each said saddle yoke portion comprises a contoured and broadened portion, whereby said seat configuration accommodates the body of the paddler in a manner which affords considerable comfort to said paddler.

15. A canoe comprising:

gunwales fore and aft support members mounted to said gunwales, first and second saddle yoke portions each having means for engaging said fore and aft support members, said fore and aft support members comprising first mounting means for locating said saddle yoke portions in respective first portions defining a seat configuration wherein said saddle yoke portions are: generally horizontal, longitudinally extended, disposed at a level above the bottom of the canoe, and spaced substantially contiguous with each other; whereby a paddler may straddle said saddle yoke portions and utilize the combined breadth of said portion to comfortably support the buttocks while sitting or kneeling in the canoe, said fore and aft support members comprising second mounting means for locating said saddle yoke portions in respective second positions defining a portage yoke configuration wherein said saddle yoke portions are: generally horizontal, longitudinally extended, disposed at a level above the bottom of the canoe, and spaced laterally apart from each other on generally opposite sides of the canoe; whereby said saddle yoke portions will define two support surfaces for engagement by the shoulders of a carrier when the canoe is inverted for transport.

* * * * *